US008998377B2

(12) United States Patent
Ozaki et al.

(10) Patent No.: US 8,998,377 B2
(45) Date of Patent: Apr. 7, 2015

(54) HEAD CLEANING APPARATUS AND DROPLET EJECTION APPARATUS

(71) Applicant: FUJIFILM Corporation, Tokyo (JP)

(72) Inventors: Yuichi Ozaki, Kanagawa (JP); Takehisa Ono, Kanagawa (JP); Noboru Kinomoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/958,213

(22) Filed: Aug. 2, 2013

(65) Prior Publication Data

US 2014/0055523 A1 Feb. 27, 2014

(30) Foreign Application Priority Data

Aug. 22, 2012 (JP) ..... 2012-183069

(51) Int. Cl.
*B41J 2/165* (2006.01)

(52) U.S. Cl.
CPC ..... *B41J 2/16538* (2013.01); *B41J 2/16535* (2013.01); *B41J 2/16552* (2013.01); *B41J 2/16585* (2013.01); *B41J 2002/1655* (2013.01)

(58) Field of Classification Search
USPC ..... 347/32–34
See application file for complete search history.

(56) References Cited

U.S. PATENT DOCUMENTS

| | | | | |
|---|---|---|---|---|
| 6,460,968 | B1 | 10/2002 | Chee et al. | |
| 2007/0068560 | A1* | 3/2007 | Shang et al. | 134/34 |
| 2012/0194610 | A1* | 8/2012 | Kyoso | 347/33 |

FOREIGN PATENT DOCUMENTS

| | | | |
|---|---|---|---|
| JP | 2002-019133 | A | 1/2002 |
| JP | 2010-099880 | A | 5/2010 |
| JP | 2010-274533 | A | 12/2010 |
| JP | 2011-067985 | A | 4/2011 |

* cited by examiner

*Primary Examiner* — Jason Uhlenhake
(74) *Attorney, Agent, or Firm* — Studebaker & Brackett PC

(57) ABSTRACT

A head cleaning apparatus is configured to move relatively along a nozzle surface of a droplet ejection head to clean the nozzle surface. The head cleaning apparatus includes: a web configured to wipe the nozzle surface; a web driving unit configured to cause the web to travel; a pair of rigid body pressing members configured to press both end portions of the web in a width direction to the nozzle surface; an elastic body pressing member provided between the pair of rigid body pressing members and provided to further protrude to a nozzle surface side than the pair of rigid body pressing members, the elastic body pressing member being configured to press a center portion of the web in the width direction to the nozzle surface; and a support member configured to support the pair of rigid body pressing members and the elastic body pressing member.

19 Claims, 12 Drawing Sheets

HEAD CLEANING APPARATUS AND DROPLET EJECTION APPARATUS

BACKGROUND OF THE INVENTION

1. Field of the Invention

The present invention relates to a head cleaning apparatus and a droplet ejection apparatus, and more particularly to a technology of bringing a web into pressing contact with a nozzle surface of a droplet ejection head to perform cleaning.

2. Description of the Related Art

If the droplet ejection head continuously performs a droplet ejection, dirt (such as mist and paper dust) is gradually attached to a nozzle surface. The dirt induces bending of the droplet ejection. Accordingly, in the droplet ejection head, cleaning of a nozzle surface is periodically performed.

The cleaning of the nozzle surface, for example, is performed by wiping the nozzle surface with a blade (wiper) or the web.

For example, in JP2002-019133A, a method of cleaning by wiping the nozzle surface with the blade is disclosed. In JP2002-019133A, in order to prevent the blade from scratching an outlet region of the nozzle and deforming the outlet region of the nozzle during the wiping operation, a contact portion with the nozzle surface of the blade is formed to be recessed.

In addition, in JP2010-099880A, as a method of cleaning the droplet ejection head having an ascendable and descendible nozzle protection member at both sides of the nozzle surface, a method is disclosed which wipes the nozzle surface with the blade by pushing up the nozzle protection member using a roller member during cleaning and exposing the nozzle surface.

On the other hand, in JP2011-067985A, a method of wiping the nozzle surface using the web is disclosed. In JP2011-067985A, a method is proposed in which, as means for bringing the web into pressing contact with the nozzle surface, a first pressure roller and a second pressure roller are provided, and both end portions of the web are pressed to be brought into pressing contact with the nozzle surface using the first pressure roller, and the center of the web is pressed to be brought into pressing contact with the nozzle surface using the second pressure roller.

In addition, in JP2010-274533A, in order to prevent the nozzle surface from being damaged by wiping, a method of forming a constant gap between the nozzle surface and the web to wipe is disclosed.

SUMMARY OF THE INVENTION

In a case of cleaning the nozzle surface by wiping, it is necessary to appropriately set a pressure while wiping to clean the nozzle surface. That is, when the pressure for wiping is high, there is a problem that the dirt is pushed inside a nozzle or the nozzle surface is damaged. On the other hand, when the pressure for wiping is low, there is a problem that the dirt is remained without being wiped.

The present invention, which is made in a view of the above described circumstances, aims to provide a head cleaning apparatus which is capable of pressing the nozzle surface with an appropriate pressure to wipe and a droplet ejection apparatus.

The above-mentioned problem may be solved by following means.

According to a first aspect, there is provided a head cleaning apparatus configured to move relatively along a nozzle surface of a droplet ejection head to clean the nozzle surface.

The head cleaning apparatus includes a web configured to wipe the nozzle surface, a web driving unit configured to cause the web to travel, a pair of rigid body pressing members configured to press both end portions of the web in a width direction to the nozzle surface, an elastic body pressing member provided between the pair of rigid body pressing members and provided to further protrude toward a nozzle surface side than the pair of rigid body pressing members, the elastic body pressing member being configured to press a center portion of the web in the width direction to the nozzle surface, and a support member configured to support the pair of rigid body pressing members and the elastic body pressing member.

According to the aspect, by bringing a web which is traveling into pressing contact with the nozzle surface, the nozzle surface is cleaned. The web (belt-shaped wiping cloth) has both end portions thereof in a width direction brought into pressing contact with the nozzle surface using the pair of rigid body pressing members, and the center portion in the width direction is brought into pressing contact with the nozzle surface using the elastic body pressing member. The elastic body pressing member is disposed between the pair of rigid body contact members and provided to further protrude toward a nozzle surface side than the pair of rigid body pressing members. Accordingly, when the rigid body pressing member and the elastic body pressing member are brought into pressing contact with the nozzle surface, the elastic body pressing member is brought into contact with the nozzle surface prior to the rigid body pressing member. Then, when the rigid body pressing member is brought into contact with the nozzle surface, the elastic body pressing member is brought into pressing contact with the nozzle surface in a crushed state. As the elastic body pressing member being brought into contact with the nozzle surface in a crushed state, a restoring force of the elastic body pressing member acts on the nozzle surface. Since the restoring force is constant, it is possible to cause a constant pressing force to act on the nozzle surface. That is, the amount of the elastic body pressing member being crushed is determined by the protrusion amount of the elastic body pressing member with respect to the rigid body pressing member. As the protrusion amount of the elastic body pressing member with respect to the rigid body pressing member is constant, the constant pressing force acts on the nozzle surface. Accordingly, it is possible to bring the web into pressing contact with the nozzle surface using a stable pressing force. In addition, by adjusting the protrusion amount of the elastic body pressing member with respect to the rigid body pressing member, it is possible to simply perform a control of the pressing force.

According to a second aspect, in the head cleaning apparatus of the above-mentioned first aspect, each elastic body pressing member may be configured by an elastic body roller, and may be supported by the support member so as to be rotatable independently.

According to the second aspect, the elastic body pressing member is configured by the elastic body roller, and is supported by the support member so as to be rotatable independently. As the elastic body pressing member being configured by the elastic body roller, it is possible to prevent the web and the elastic body pressing member (elastic body roller) from slipping therewith and to stably bring the web into pressing contact with the nozzle surface.

According to a third aspect, in the head cleaning apparatus of the above-mentioned second aspect, the rigid body pressing member may be configured by a rigid body roller and may be supported by the support member so as to be rotatable independently.

According to the third aspect, the rigid body pressing member is configured by the rigid body roller, and is supported by the support member so as to be rotatable independently. As the rigid body pressing member being configured by the rigid body roller, it is possible to prevent the web and the rigid body pressing member (rigid body roller) from slipping therewith and to stably bring the web into pressing contact with the nozzle surface.

According to a fourth aspect, in the head cleaning apparatus of the above-mentioned third aspect, an outer diameter of the elastic body roller may be larger than an outer diameter of the rigid body roller, and the elastic body roller and the rigid body roller may be coaxially provided.

According to the fourth aspect, the outer diameter of the elastic body roller is formed to be larger than the outer diameter of the rigid body roller, and the elastic body roller and the rigid body roller are coaxially disposed. Accordingly, it is possible to adjust the pressing force using a difference in outer diameter, and thereby to simplify a configuration. In addition, the elastic body roller and the rigid body roller are supported so as to be rotatable independently from each other, so that, even in a case where peripheral speeds thereof are different from each other, it is possible to stably bring the web into pressing contact with the nozzle surface without causing the slip to occur.

According to a fifth aspect, in the head cleaning apparatus of any one of the above-mentioned first to fourth aspects, the nozzle surface of the droplet ejection head may include a nozzle region at the center portion of the nozzle surface in the width direction and a non-nozzle regions at both end portions of the nozzle surface in the width direction. The pair of rigid body pressing members may be configured to press respective end portions of the web in the width direction to the non-nozzle regions.

According to the fifth aspect, on the nozzle surface of the droplet ejection head, the nozzle region (a region in which a nozzle is formed) is formed at the center portion in the width direction, and the non-nozzle region (a region in which the nozzle is not formed) is formed at both of the end portions in the width direction. The pair of rigid body pressing members brings both of the end portions of the web in the width direction into pressing contact with the non-nozzle regions. Accordingly, at least the nozzle region is brought into pressing contact with the web by the elastic body pressing member, and is wiped by the web using the constant pressing force. In general, the nozzle region is provided with a liquid-repellent film. By pressing the nozzle surface using the elastic body pressing member, it is possible to wipe the nozzle surface using an appropriate pressure, and to prevent the liquid-repellent film from being damaged. Accordingly, it is possible to prolong durability of a head.

According to a sixth aspect, in the head cleaning apparatus of the above-mentioned fifth aspect, the elastic body pressing member may be wider than the nozzle region in width.

According to the sixth aspect, the elastic body pressing member is wider than the nozzle region in width. Accordingly, it is possible to wipe the nozzle region using an appropriate pressure. In addition, even in a case where the nozzle region is formed to be retreated in a recessed shape with respect to the non-nozzle region, it is possible to appropriately wipe a stepped portion formed between the nozzle region and the non-nozzle region.

According to a seventh aspect, the head cleaning apparatus of any one of the above-mentioned first to sixth aspects may further include a biasing unit configured to bias the support member toward the nozzle surface.

According to the seventh aspect, the head cleaning apparatus further includes the biasing unit configured to bias the support member toward the nozzle surface. Accordingly, even without strict alignment with respect to the nozzle surface, it is possible to appropriately bring the elastic body pressing member and the rigid body pressing member into pressing contact with the nozzle surface. In addition, since an actual pressing force is determined by the protrusion amount of the elastic body pressing member, it is possible to provide a sufficiently large biasing force provided by the biasing unit with respect to external disturbance.

According to an eighth aspect, in the head cleaning apparatus of the above-mentioned seventh aspect, the biasing unit may be configured in a pair and may bias both end portions of the support member in the width direction.

According to the eighth aspect, the biasing unit is configured in a pair, and both of the end portions of the support member in the width direction is biased. Accordingly, it is possible to bring the elastic body pressing member and the rigid body pressing member into pressing contact with the nozzle surface along the nozzle surface.

According to a ninth aspect, the head cleaning apparatus of any one of the above-mentioned first to eighth aspects may further include a cleaning solution providing unit providing the web with a cleaning solution. The web moisturized with the cleaning solution may be brought into pressing contact with the nozzle surface using the pair of rigid body pressing members and the elastic body pressing member.

According to the ninth aspect, the head cleaning apparatus further includes the cleaning solution providing unit configured to provide the web with the cleaning solution. The web moisturized with the cleaning solution is brought into pressing contact with the nozzle surface, and thereby the nozzle surface is cleaned.

According to a tenth aspect, there is provided a droplet ejection apparatus which includes a recording medium transportation unit configured to transport a recording medium, a droplet ejection head configured to eject a droplet to the recording medium transported by the recording medium transportation unit, and the head cleaning apparatus according to any one of the above-mentioned first to ninth aspects, configured to moves relatively along a nozzle surface of the droplet ejection head to clean the nozzle surface.

According to the tenth aspect, the head cleaning apparatus of any one of the above-mentioned first to ninth aspects is incorporated in the droplet ejection apparatus.

According to the present invention, it is possible to wipe the nozzle surface with an appropriate pressure.

DESCRIPTION OF THE PREFERRED EMBODIMENTS

An exemplary embodiment of the present invention will be described hereinafter with reference to the accompanying drawings.

In the embodiment, a case will be described where the present invention is applied to the ink jet recording apparatus as a droplet ejection apparatus as an example.

Ink Jet Recording Apparatus

Apparatus Configuration

Figure 1:
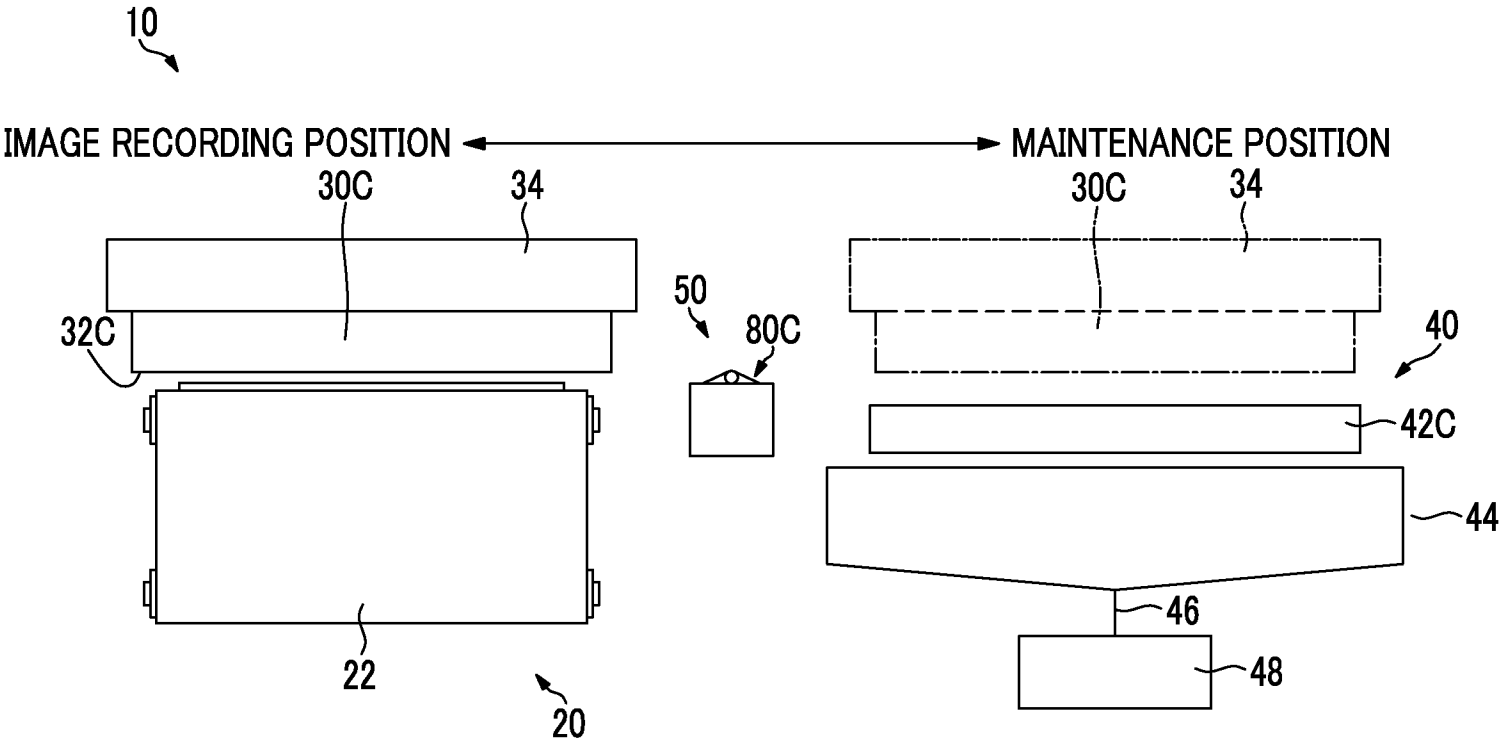
FIG. 1 is a front view illustrating a configuration of a main part of an embodiment of an ink jet recording apparatus.
Figure 2:
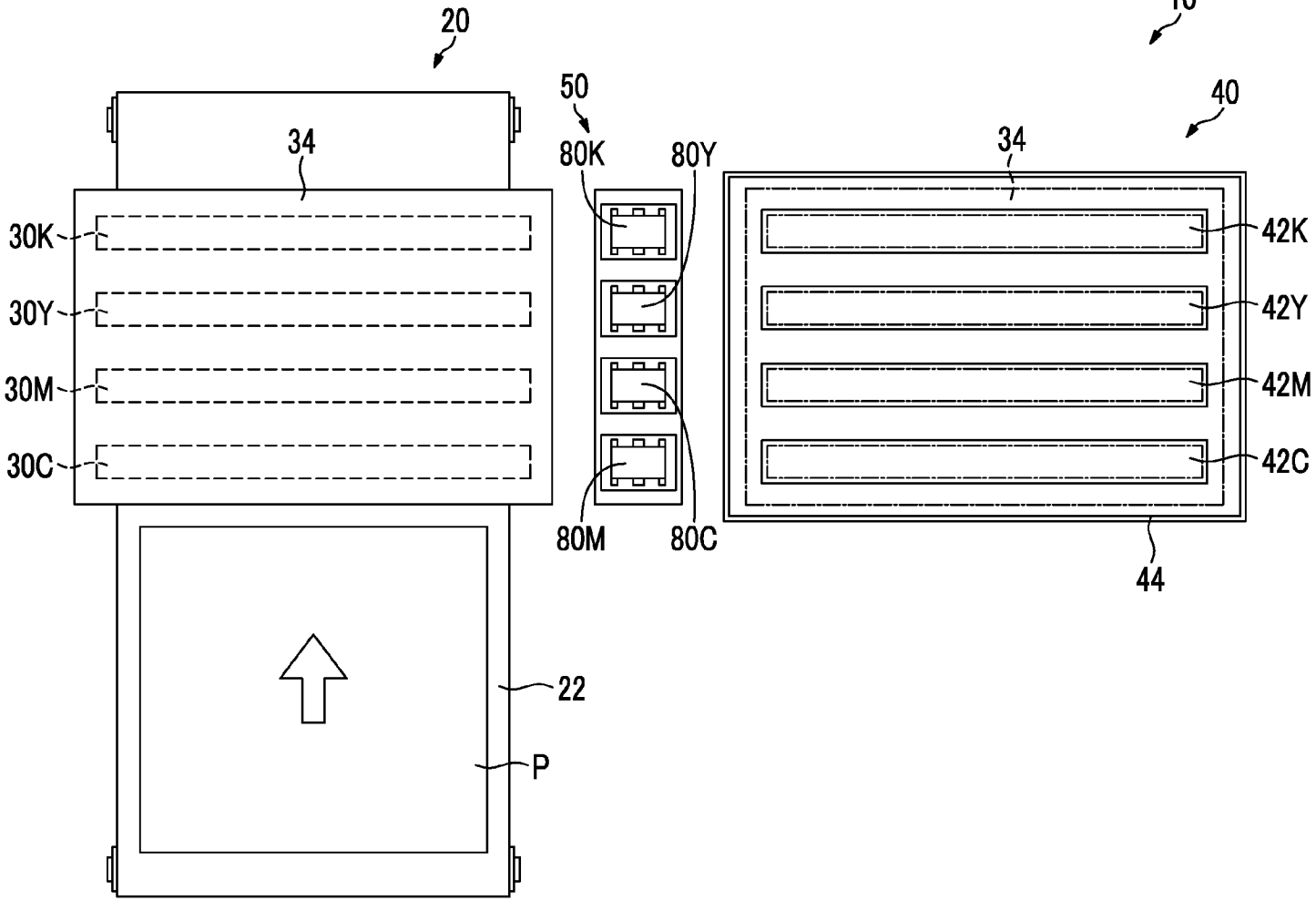
FIG. 2 is a plan view illustrating a configuration of the main part of an embodiment of the ink jet recording apparatus.
Figure 3:
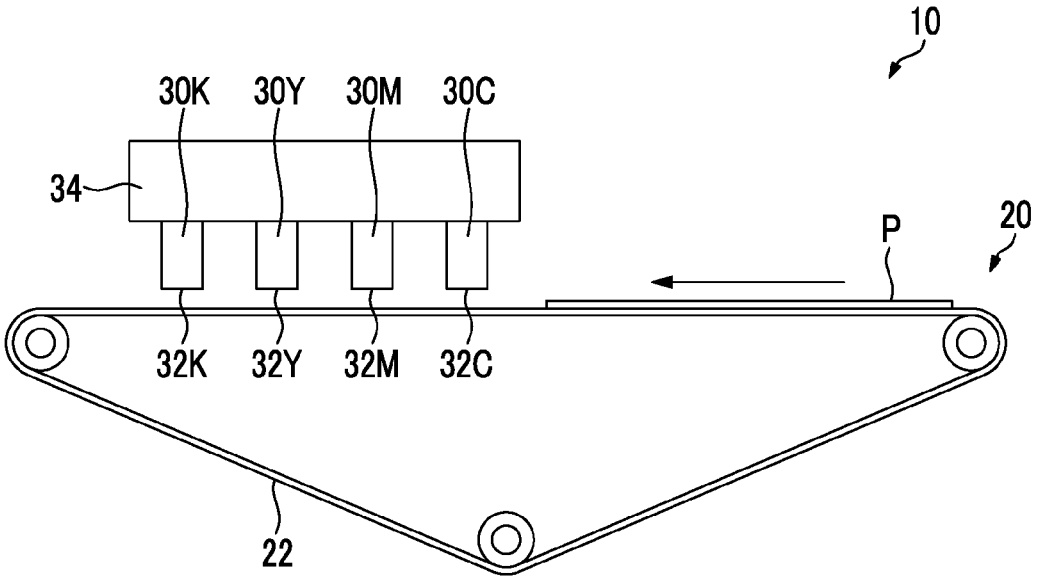
FIG. 3 is a side view illustrating a configuration of the main part of an embodiment of the ink jet recording apparatus.

FIGS. 1 to 3 are respectively a front view, a plan view, and a side view illustrating a configuration of a main part of an ink jet recording apparatus according to the exemplary embodiment.

An ink jet recording apparatus 10 illustrated these drawings is a color ink jet printer recording a color image on a sheet P (recording medium) by using four color inks such as Cyan (C), Magenta (M), Yellow (Y), and Black(K). The ink jet recording apparatus 10 includes a sheet transportation device 20 functioning as the recording medium transportation unit, ink jet heads (hereinafter referred to as heads) 30C, 30M, 30Y, and 30K functioning as the droplet ejection head, a maintenance unit 40, and a cleaning unit 50. The sheet transportation device 20 transports the sheet P. The heads 30C, 30M, 30Y, and 30K eject an ink droplet of the respective colors C, M, Y, and K to the sheet P transported using the sheet transportation device 20 to record an image. The maintenance unit 40 performs storage and maintenance of the respective heads 30C, 30M, 30Y, and 30K. The cleaning unit 50 cleans a nozzle surface of the respective heads 30C, 30M, 30Y, and 30K.

Sheet Transportation Device

The sheet transportation device 20 belt-transports the sheet P. That is, by adsorbing and holding the sheet P onto the surface of a transportation head 22 in an endless shape to cause the transportation head 22 to travel, the sheet P is transported. In the transportation head 22, a travel path is set so that a portion thereof may be horizontal. The sheet P is transported in a region where the transportation belt 22 horizontally travels. That is, the sheet P is adsorbed and held onto the region in which the transportation belt 22 horizontally travels to be horizontally transported. For adsorption of the sheet P, for example, it is possible to adopt a method using vacuum adsorption, a method using electrostatic adsorption, and the like. With regard to such a transportation mechanism of the sheet P, there is a known technology. Accordingly, the detailed configuration is not described herein.

Ink Jet Head

A head includes a head 30C ejecting an ink droplet of cyan (C), a head 30M ejecting an ink droplet of magenta (M), a head 30Y ejecting an ink droplet of yellow (Y), and a head 30K ejecting an ink droplet of black (K). The respective heads 30C, 30M, 30Y, and 30K are configured by line heads. The respective heads 30C, 30M, 30Y, and 30K have the same configuration, so that, except when a particular distinction is made, they are referred to as a head 30X (30C, 30M, 30Y, and 30K).

In the head 30X, a nozzle surface 32X is formed at the tip end thereof, and a nozzle N for ejecting an ink to the nozzle surface 32X is formed.

Figure 4:
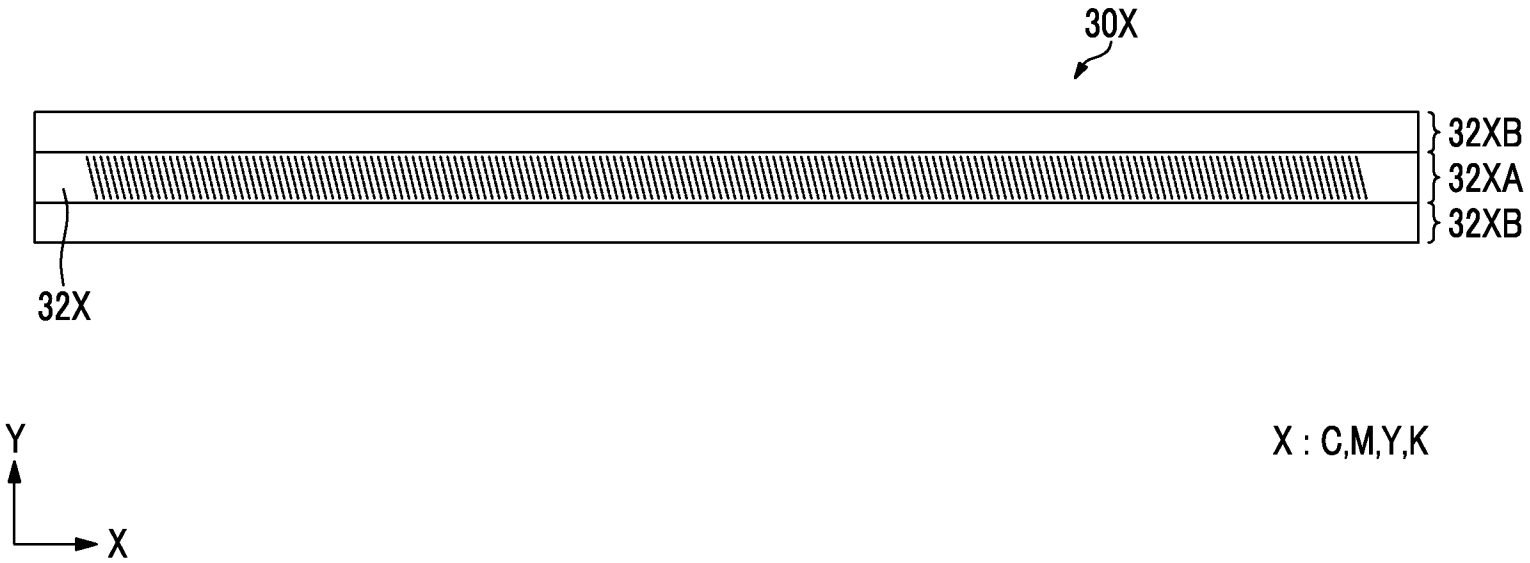
FIG. 4 is a plan view of a nozzle surface of a head.
Figure 5:
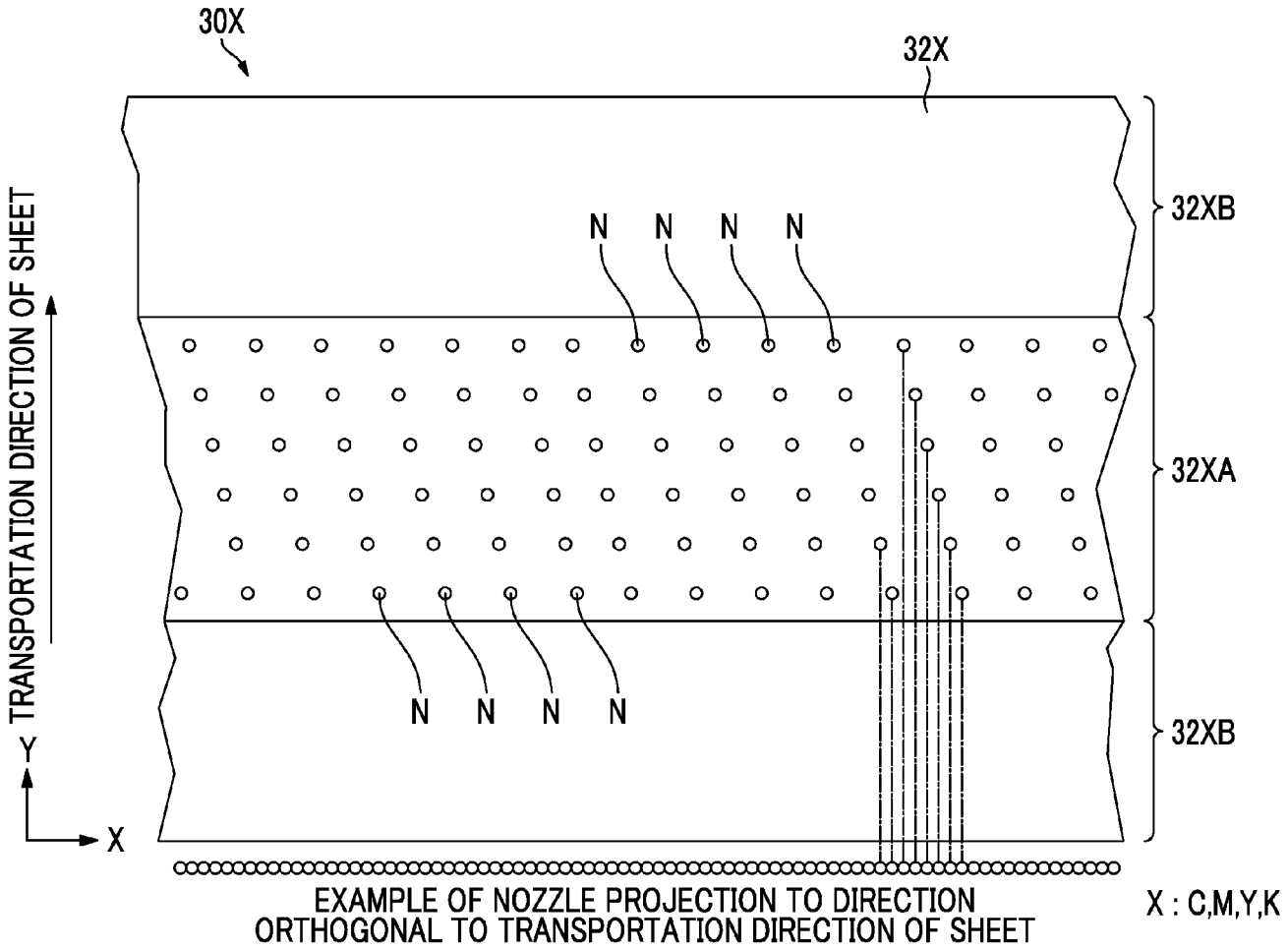
FIG. 5 is an enlarged view of a portion of FIG. 4.

FIG. 4 is a plan view of the nozzle surface of a head. In addition, FIG. 5 is an enlarged view enlarging a portion of the FIG. 4.

In the head 30X of the embodiment, the nozzle surface 32X is formed in a rectangular shape. A nozzle N is formed along the longitudinal direction of the nozzle surface 32X (a direction orthogonal to the transportation direction of the sheet P: X axis direction in the drawing).

Here, in the head 30X of the present embodiment, a nozzle region 32XA is formed at a center portion of the nozzle surface 32X in a width direction (Y axis direction in the drawing), and non-nozzle regions 32XB are formed at both sides interposing the nozzle region 32XA therebetween. The nozzle N is formed only in the nozzle region 32XA. A liquid-repellent processing (for example, coating by the liquid-repellent film) is performed in the nozzle region 32XA. Moreover, the liquid-repellent processing may also be performed entirely on the nozzle surface 32X.

Here, in the head 30X of the present embodiment, the nozzle N is disposed on the nozzle surface 32X in a two dimensional matrix shape. Specifically, as illustrated in FIG. 4, the nozzle N is disposed at a constant pitch along the longitudinal direction of the nozzle surface 32X, and is disposed at a constant pitch along a straight line extending in direction inclined at a predetermined angle with respect to the longitudinal direction. Disposing the nozzle N makes it possible to narrow an actual interval of the nozzle N projected in the longitudinal direction of the head 30X, thereby achieving high density of the nozzle N.

Each head 30X is attached to a head support frame 34 to be integrated (unitization). The head support frame 34 includes a head attachment portion (not illustrated) for attaching each head 30X, and each head 30X is detachably attached to the head attachment portion.

Each head 30X attached to the head support frame 34 is disposed to be orthogonal to the transportation direction of the sheet P. In addition, each head 30X is disposed along the transportation direction of the sheet P in a predetermined order at constant intervals (in the present example, it is disposed in an order of C, M, Y and K at constant intervals).

The head attachment portion is provided to be ascendable and descendible on the head support frame 34, and ascends and descends using an ascending and descending mechanism which is not illustrated. Each head 30X attached to the head attachment portion moves in a vertical direction (vertical direction with respect to the sheet P transported by the sheet transportation device 20: Z axis direction in the drawing) using the ascending and descending mechanism. Accordingly, it is possible to adjust a distance (throw distance) between the nozzle surface 32X and the sheet P.

The head support frame 34 is provided to be horizontally movable in a direction (X axis direction in the drawing) orthogonal to the transportation direction (Y axis direction in the drawing) of the sheet P using a head moving mechanism which is not illustrated. The head moving mechanism, for example, is configured to include a ceiling frame horizontally installed across the sheet transportation device 20, a guide rail laid on the ceiling frame, a traveling body slidingly moving on the guide rail, driving means (for example, a feed screw mechanism and the like) causing the traveling body to move along the guide rail. The head support frame 34 is attached to a traveling body and horizontally slidingly moves.

Each head 30X attached to the head support frame 34, by the head support frame 34 horizontally moving, moves along the longitudinal direction (a direction orthogonal to the transportation direction of the sheet P: X axis direction in the drawing) to move between a predetermined image recording position and a maintenance position.

If each head 30X is positioned at the image recording position, each head 30X is disposed on the transportation path of the sheet P transported by the sheet transportation device 20. Accordingly, it is possible to eject an ink droplet toward the sheet P transported by the sheet transportation device 20. That is, it is possible to record an image on the sheet P.

On the other hand, if each head 30X is positioned at the maintenance position, each head 30X is positioned at an installation position of the maintenance unit 40.

Maintenance Unit

The maintenance unit 40 includes a cap 42X (42C, 42M, 42Y 42K) covering the nozzle surface 32X of each head 30X. The cap 42X is included in each head, and individually covers the nozzle surface 32X of each head 30X. If each head 30X is positioned at the maintenance position, each head 30X is positioned on the cap 42X. In a case where the apparatus stops operating or the like, the nozzle surface 32X of the head 30X is covered using the cap 42X. Accordingly, an ink in the nozzle is prevented from drying.

In the cap 42X, a pressurizing and absorbing mechanism (not illustrated) for pressurizing and absorbing inside the nozzle is included. In a case where an ejection failure or the like occurs, by using the pressurizing and absorbing mechanism of the cap 42X, an appropriate restoring processing is performed.

A waste liquid tray 44 is disposed at the lower side of the cap 42X. An ink absorbed using the cap 42X is discarded to the waste liquid tray 44 and collected in a waste liquid tank 48 through a waste collection pipe 46.

Cleaning Unit

A cleaning unit 50 is disposed between the sheet transportation device 20 and the maintenance unit 40. The cleaning unit 50 individually cleans the nozzle surfaces 32C, 32M, 32Y, and 32K of the respective heads 30C, 30M, 30Y, and 30K during a movement of the heads 30C, 30M, 30Y, and 30K from the maintenance position to the image recording position.

The cleaning unit 50 is configured so that head cleaning apparatuses 80C, 80M, 80Y, and 80K may be integrated, which individually clean the nozzle surfaces 32C, 32M, 32Y, and 32K of the respective heads 30C, 30M, 30Y, and 30K.

The respective head cleaning apparatuses 80C, 80M, 80Y, and 80K wipe the nozzle surface 32C, 32M, 32Y, and 32K with the web to clean the nozzle surfaces 32C, 32M, 32Y, and 32K.

With regard to a configuration of the head cleaning apparatuses 80C, 80M, 80Y, and 80K will be described below.

Image Recording Method

Next, an image recording method using the ink jet recording apparatus 10 will be briefly described.

When recording an image, the head 30X is positioned at the image recording position.

The sheet P is fed to the sheet transportation device 20 using a sheet feeding mechanism which is not illustrated. If needed, a predetermined previous processing (for example, application of a processing solution having a function of condensing a color material, and the like) is performed. The sheet transportation device 20 receives the sheet P fed by the sheet feeding mechanism and horizontally transports the sheet P.

Each head 30X ejects an ink droplet to the sheet P transported using the sheet transportation device 20, and records an image on the surface of the sheet P.

The sheet P on which an image is recorded is collected from the sheet transportation device 20 using a collection mechanism which is not illustrated. If needed, processing such as drying, fixing, and the like is performed.

By sequentially feeding the sheet P, a recording processing of an image is sequentially performed.

Head Cleaning Apparatus

Entire Configuration of Head Cleaning Apparatus

Next, a configuration of head cleaning apparatuses 80C, 80M, 80Y, and 80K will be described.

The head cleaning apparatuses 80C, 80M, 80Y, and 80K each have the same configuration, so that, except when a particular distinction is made, they are referred to as a head cleaning apparatus 80X (80C, 80M, 80Y, and 80K), and the configuration is described.

Figure 6:
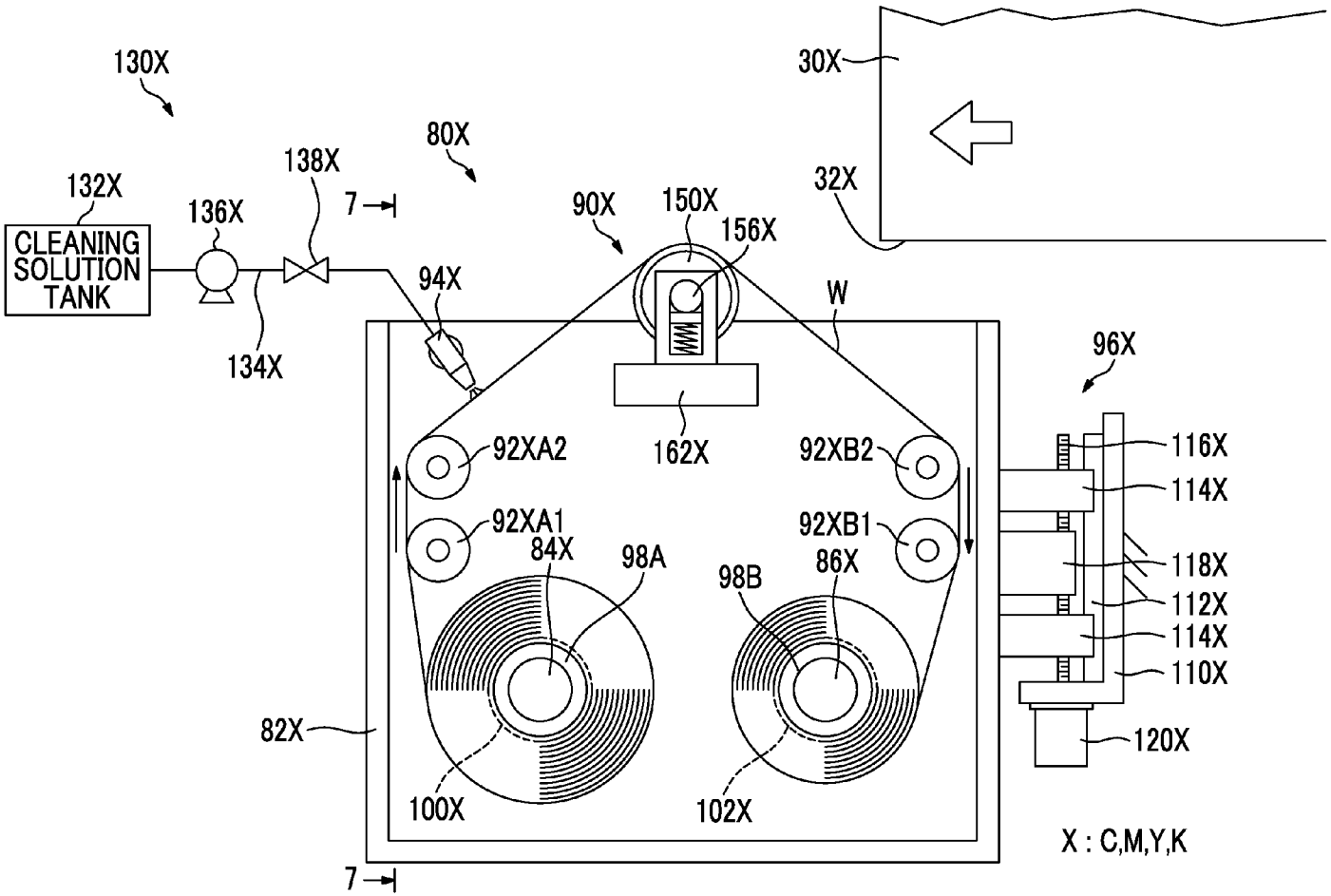
FIG. 6 is a side view illustrating a schematic configuration of the head cleaning apparatus.

FIG. 6 is a side view illustrating a schematic configuration of the head cleaning apparatus. In addition, FIG. 7 is a cross-sectional diagram taken along a line 7-7 of FIG. 6.

The head cleaning apparatus 80X brings the web W moisturized with the cleaning solution into a pressuring contact with the nozzle surface 32X of the head 30X moving from the maintenance position to the image recording position, thereby wiping and cleaning the nozzle surface 32X using the web W.

Figure 7:
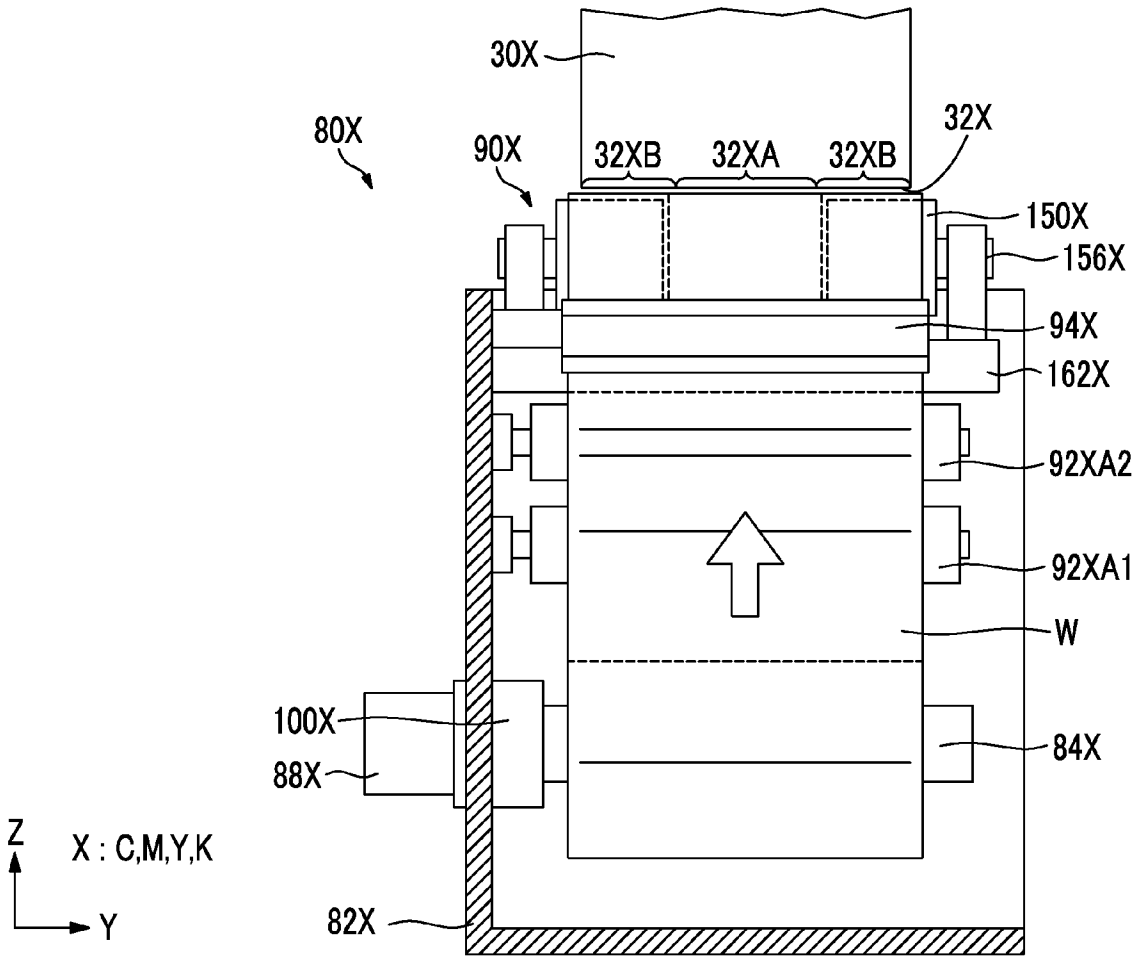
FIG. 7 is a cross-sectional view taken along a line 7-7 of FIG. 6.

As illustrated in FIGS. 6 and 7, the head cleaning apparatus 80X includes a head cleaning apparatus main body frame 82X, a feeding shaft 84X feeding the web W, and a winding shaft 86X winding the web W. In addition, the head cleaning apparatus 80X includes a winding motor 88X winding the web W, a pressing unit 90X bringing the web W into pressing contact with the nozzle surface 32X, and guide rollers 92XA1, 92XA2, 92XB1, and 92XB2 guiding the travel of the web W. Furthermore, the head cleaning apparatus 80X includes a cleaning solution nozzle 94X dispensing the cleaning solution to the web W to moisturize the web W, and an ascending and descending device 96X causing the head cleaning apparatus main boy frame 82X to ascend and descend.

The web W is configured by, for example, a wiping cloth that is made by weaving or knitting of microfiber (for example, single yarn fineness (thinness of one yarn) at 0.07 dexitex (about 2 μm)) and is formed in the belt shape. The width of the web W is formed according to the width of the nozzle surface 32X (a width in a direction orthogonal to the longitudinal direction), and formed to be slightly wider than the width of the nozzle surface 32X so as to be capable of wiping an entire region of the nozzle surface 32X with one-time wiping.

The web W is wound around a feeding core (winding core) 98A and provided in a roll shape. In addition, a winding core 98B (a core for winding the web W) is attached to the tip end thereof.

The feeding shaft 84X and the winding shaft 86X are disposed in parallel to each other, and disposed to be orthogonal to a moving direction of the head 30X (in the embodiment, the longitudinal direction (X axis direction in the drawing) of the head 30X), respectively. In addition, these are disposed in parallel with respect to the nozzle surface 32X of the head 30X, respectively.

In the head cleaning apparatus main body frame 82X, the feeding shaft support portion 100X supporting the feeding shaft 84X and a winding shaft support portion 102X supporting the winding shaft 86X are provided. The feeding shaft 84X is supported by the feeding shaft support portion 100X, and is attached to the head cleaning apparatus main body frame 82X. In addition, the winding shaft 86X is supported by the winding shaft support portion 102X, and is attached to the head cleaning apparatus main body frame 82X. In the embodiment, the feeding shaft 84X and the winding shaft 86X are disposed in parallel with each other at constant intervals in a transverse direction (X axis direction).

The web W is mounted on the head cleaning apparatus 80X with the feeding core 98A mounted on the feeding shaft 84X and the winding core 98B mounted on the winding shaft 86X.

In the feeding shaft 84X, a friction mechanism and a reverse rotation prevention mechanism which are not illustrated are included, and are configured so as to rotate only in one direction (the feeding direction of the web W) with a constant resistance. Accordingly, when feeding the web W, it is possible to provide a given load.

In addition, in the winding shaft 86X, a torque limiter which is not illustrated is included, and is configured to slide if a given load (torque) or a stronger load is applied in a rotation direction. Accordingly, it is possible to prevent the tension more than needed from being applied to the web W. In addition, it is possible to maintain a constant tension all the time to cause the web W to travel.

The winding motor 88X is provided on the head cleaning apparatus main body frame 82X. The winding motor 88X is connected to the winding shaft 86X to rotatably drive the winding shaft 86X. Therefore, driving the winding motor 88X makes it possible to wind the web W around the winding core 98B mounted on the winding shaft 86X. The feeding shaft 84X, the winding shaft 86X, and the winding motor 88X each are an aspect of a web driving unit causing the web W to travel.

The pressing unit 90X is disposed between the feeding shaft 84X and the winding shaft 86X, and brings the web W traveling from the feeding shaft 84X to the winding shaft 86X into pressing contact with the nozzle surface 32X. The pressing unit 90X includes a pressure roller 150X, and brings the web W into pressing contact with the nozzle surface 32X using the pressure roller 150X.

The pressure roller 150X includes a pair of rigid body rollers 150XB functioning as the rigid body pressing member and an elastic body roller 150XA functioning as the elastic body pressing member. The pair of rigid body rollers 150XB and the elastic body roller are coaxially disposed. The pair of rigid body rollers 150XB are provided with the elastic body roller 150XA interposed therebetween, and are configured to press the non-nozzle regions 32XB of the nozzle surface 32X. In addition, the elastic body roller 150XA is provided so as to press the nozzle region 32XA of the nozzle surface 32X. Moreover, the outer diameter of the elastic body roller 150XA is formed to be larger than the outer diameter of the rigid body roller 150XB, and is formed to protrude from the outer periphery of the rigid body roller 150XB.

When the web W is brought into pressing contact with the nozzle surface 32X using the pressure roller 150X, both of the end portions of the web W in the width direction are brought into pressing contact with the nozzle surface 32X using the pair of rigid body rollers 150XB, and the center portion thereof is brought into pressing contact with the nozzle surface 32X using the elastic body roller 150XA.

The pair of rigid body rollers 150XB have rigidity, and are brought into pressing contact with the nozzle surface 32X without being deformed.

On the other hand, the elastic body roller 150XA is formed to be elastically deformable, and the outer diameter thereof is formed to be larger than the output diameter of the rigid roller 150XB. Accordingly, when the web W is brought into pressing contact with the nozzle surface 32X using the pressure roller 150X, the web W is brought into contact with the nozzle surface 32X in a crushed state. As the elastic body roller 150X is brought into contact with the nozzle 32X in a crushed state, it is possible to press the nozzle surface 32X with a constant pressing force. That is, the elastic body roller 150XA being crushed, the elastic restoring force thereof acts on the nozzle surface 32X. Since the elastic restoring force is constant, it is possible to cause a constant pressure to act on the nozzle surface 32X all the time. Accordingly, it is possible to wipe the nozzle surface 32X with an appropriate pressing force.

A configuration of the pressing unit 90X including the pressure roller 150X will be described in more detail below.

The plurality of guide rollers 92XA1, 92XA2, 92XB1, and 92XB2 guide the travel of the web W so that the web W fed from the feeding shaft 84X may travel in a predetermined travel path to be wound at the winding shaft 86X. The plurality of guide rollers include the guide rollers 92XA1 and 92XA2 on a feeding side, which guide the web W fed from the feeding shaft 84X may travel in the predetermined travel path to be wound around the pressure roller 150X, and guide rollers 92XB1 and 92XB2 on a winding side, which guide so that the web W wound around the pressure roller 150X may travel in the predetermined travel path to be wound around the winding shaft 86X.

The guide roller on the feeding side includes a first feeding guide roller 92XA1 and a second feeding guide roller 92XA2. The web W fed from the feeding shaft 84X is wound around the first feeding guide roller 92XA1 and the second feeding guide roller 92XA2 to be wound around the pressure roller 150X.

The guide roller on the winding side includes a first winding guide roller 92XB1 and a second winding guide roller 92XB2. The web W wound around the pressure roller 150X is wound around the second winding guide roller 92XB2 and a first winding guide roller 92XB1 to be wound around the winding shaft 86X.

Here, the second feeding guide roller 92XA2 and the second winding guide roller 92XB2 which are disposed right ahead and behind the pressure unit 90X are disposed to be horizontally symmetric with respect to the pressure unit 90X, and are disposed so that the web W may be wound around the peripheral surface at the upper side of the pressure unit 90X. That is, the second feeding guide roller 92XA2 and the second winding guide roller 92XB2 are disposed at a position even lower than the pressure roller 150X of the pressure unit 90X, and are disposed so that the web W may be wound around the pressure roller 150X in a mountain shape.

The cleaning solution nozzle 94X dispenses a cleaning solution to the web W between the second feeding guide roller 92XA2 and the pressure unit 90X to moisturize the web W. That is, the cleaning solution nozzle 94X dispenses the cleaning solution to the web W at a position on the upper stream side of the pressure unit 90X with respect to the traveling direction of the web W to moisturize the web W.

The cleaning solution nozzle 94X is formed in a rod shape, and disposed to be orthogonal to the traveling direction of the web W. An ejection port is formed on a surface facing the web W of the cleaning solution nozzle 94X, and the cleaning solution is dispensed from the ejection port to the web W.

The cleaning solution is supplied from a cleaning solution supply device 130X. The cleaning solution supply device 130X is configured to include a cleaning solution tank 132X in which the cleaning solution is stored, a cleaning solution pipe 134X connecting the cleaning solution tank 132X and the cleaning solution nozzle 94X, a cleaning solution pump 136X disposed in the middle of the cleaning solution pipe 134X and sending the cleaning solution stored in the cleaning tank 132X to the cleaning solution nozzle 94X through the cleaning solution pipe 134X, and a cleaning solution valve 138X installed in the middle of the cleaning solution pipe 134X and opening and closing a pipe path of the cleaning solution pipe 134X. By opening the cleaning solution valve 138X and driving the cleaning solution pump 136X, the cleaning solution stored in the cleaning solution tank 132X is supplied to the cleaning solution nozzle 94X through the cleaning solution pipe 134X. Accordingly, the cleaning solution is dispensed from the ejection port of the cleaning solution nozzle 94X. The cleaning solution nozzle 94X and the cleaning solution supply device 130X each are an aspect of the cleaning solution supply unit.

The ascending and descending device 96X is attached to the main body frame of the ink jet recording apparatus 10 to move the head cleaning apparatus main body frame 82X in the vertical direction (Z axis direction in the drawing). The ascending and descending device 96X is configured by a so-called feed screw mechanism, and includes an ascending and descending device base frame 110X, a guide rail 112X, a slider 114X, a screw rod 116X, a nut member 118X, and an ascending and descending motor 120X.

The ascending and descending device base frame 110X is attached to a main body frame (not illustrated) of the ink jet recording apparatus 10.

The guide rail 112X is laid on the ascending and descending base frame 110X. The guide rail 112X is laid along the vertical direction (Z axis direction in the drawing).

A slider 114X is slidably provided along the guide rail 112X. The head cleaning apparatus main body frame 82X is attached to the slide 114X, and is slidably provided in the vertical direction.

The screw rod 116X is rotatably supported by the ascending and descending device head system 110X through a bearing (not illustrated). The screw rod 116X is disposed to be parallel to the guide rail 112X.

The nut member 118X is attached to the screw rod 116X. The head cleaning apparatus main body frame 82X is connected to the nut member 118X. Accordingly, if the screw rod 116X is rotated, the head cleaning apparatus main body frame 82X vertically moves according to the rotation direction and the amount of rotations.

The ascending and descending motor 120X is provided on the ascending and descending device head frame 110X, and rotatably drives the screw rod 116X.

The ascending and descending device 96X is configured as described above. If the ascending and descending motor 120X is driven to rotate the screw rod 116X, the head cleaning apparatus main body frame 82X vertically moves according to the rotation direction and the amount of rotations. The head cleaning apparatus 80X is driven by the ascending and descending device 96X to move in the vertical direction (Z axis direction in the drawing) between a predetermined "wiping position" and "a waiting position".

Here, the wiping position is set to a position in which the pressure unit 90X is brought into pressing contact with the nozzle surface 32X of the head 30X passing above the head cleaning apparatus 80X. In addition, the waiting position is set to a position in which the pressure unit 90X is spaced at a predetermined interval from the nozzle surface 32X of the head 30X passing above the head cleaning apparatus 80X. Accordingly, if the head cleaning apparatus 80X is moved to the wiping position, it is possible to bring the web W wound around the pressure unit 90X into pressing contact with the nozzle surface 32X of the head 30X. If the head cleaning apparatus 80X is moved to the waiting position, it is possible to cause the head 30X to pass without bringing the web W into contact with the nozzle surface 32X of the head 30X.

The head cleaning apparatus 80X is configured as described above.

Operation during Cleaning

Cleaning of the nozzle surface 32X is performed by moving the head 30X from the maintenance position to the image recording position at a constant speed. If the head 30X is moved, the head cleaning apparatus 80X relatively moves along the nozzle surface 32X of the head 30X. Accordingly, it is possible to clean the nozzle surface 32X of the head 30X using the head cleaning apparatus 80X.

If the head 30X starts to move, the cleaning solution valve 138X is opened and the cleaning solution pump 136X is driven. Accordingly, the clean solution is dispensed from the cleaning solution nozzle 94X to the web W, and thereby the web W is moisturized.

In addition, the winding motor 88X is driven at the same time. Accordingly, the web W wound around the feeding shaft 84X is wound around the winding shaft 86X. Accordingly, the web W travels in one direction at a constant speed. The traveling direction of the web W at this time is opposite to the moving direction of the head 30X.

If the tip end of the head 30X (in this case, an end portion of the image recording position side) reaches right before the installation position of the head cleaning apparatus 80X, the ascending and descending device 96X is driven, and the head cleaning apparatus 80X moves from the waiting position to the wiping position. Accordingly, it is possible to bring the web W wound around the pressure roller 150X into contact with the nozzle surface 32X of the head 30X.

The head 30X moves to pass through the head cleaning apparatus 80X, and accordingly the web W is brought into contact with the nozzle surface 32X and the nozzle surface 32X is wiped.

If the rear end (In this case, an end portion of the maintenance position side) of the moving head 30X passes through the head cleaning apparatus 80X, driving the clean solution pump 136X is stopped and the cleaning solution valve 138X is closed. Accordingly, supplying the cleaning solution to the web W is stopped. In addition, the ascending and descending device 96X is driven, the head cleaning apparatus 80X moves from the wiping position to the waiting position.

Using the above series of processes, the cleaning of the nozzle surface 32X of the head 30X is completed. The nozzle surface 32X of the head 30X is wiped using the moisturized web W to be cleaned.

Pressure Unit

Configuration of Pressure Unit

The pressure unit 90X is a unit bringing the web W into pressing contact with the nozzle surface 32X.

Figure 8:
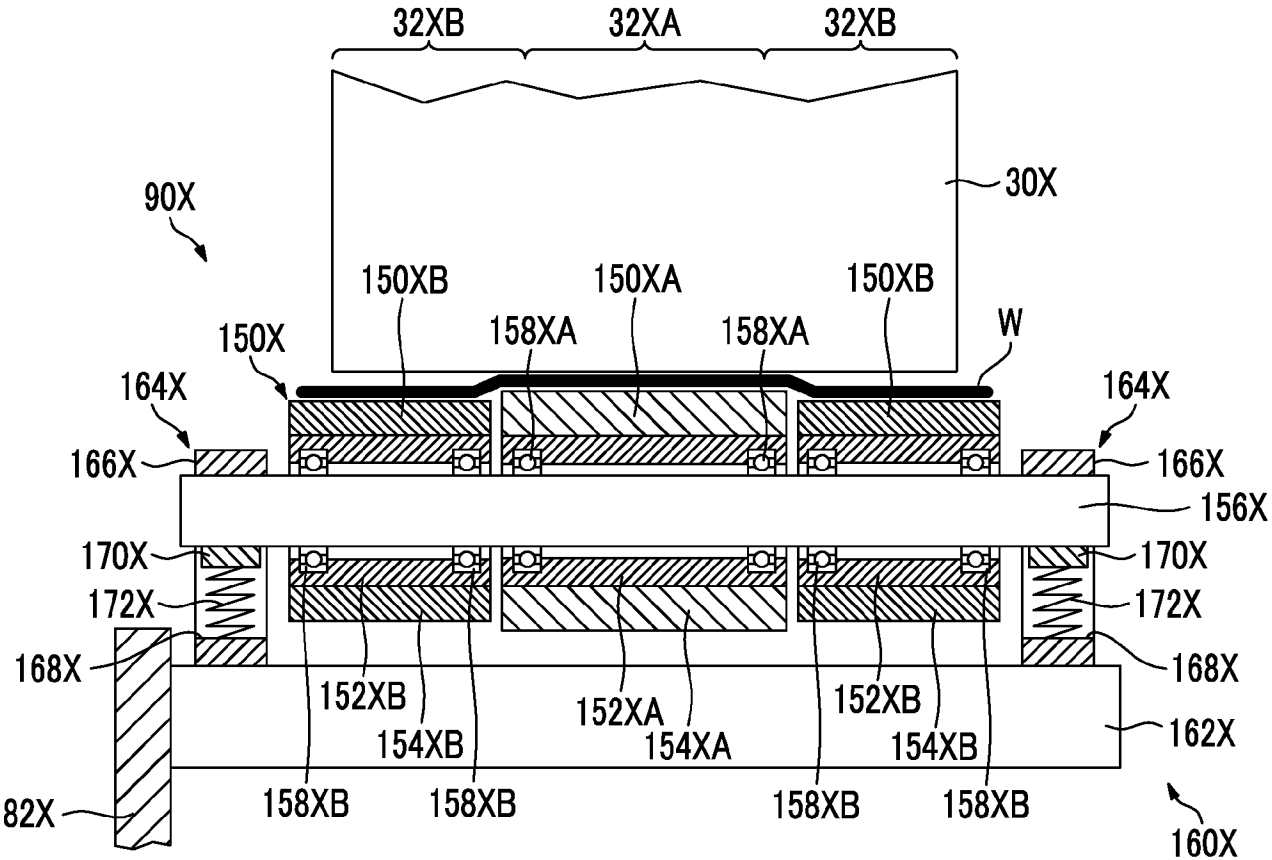
FIG. 8 is a front view illustrating a configuration of a pressure unit.
Figure 9:
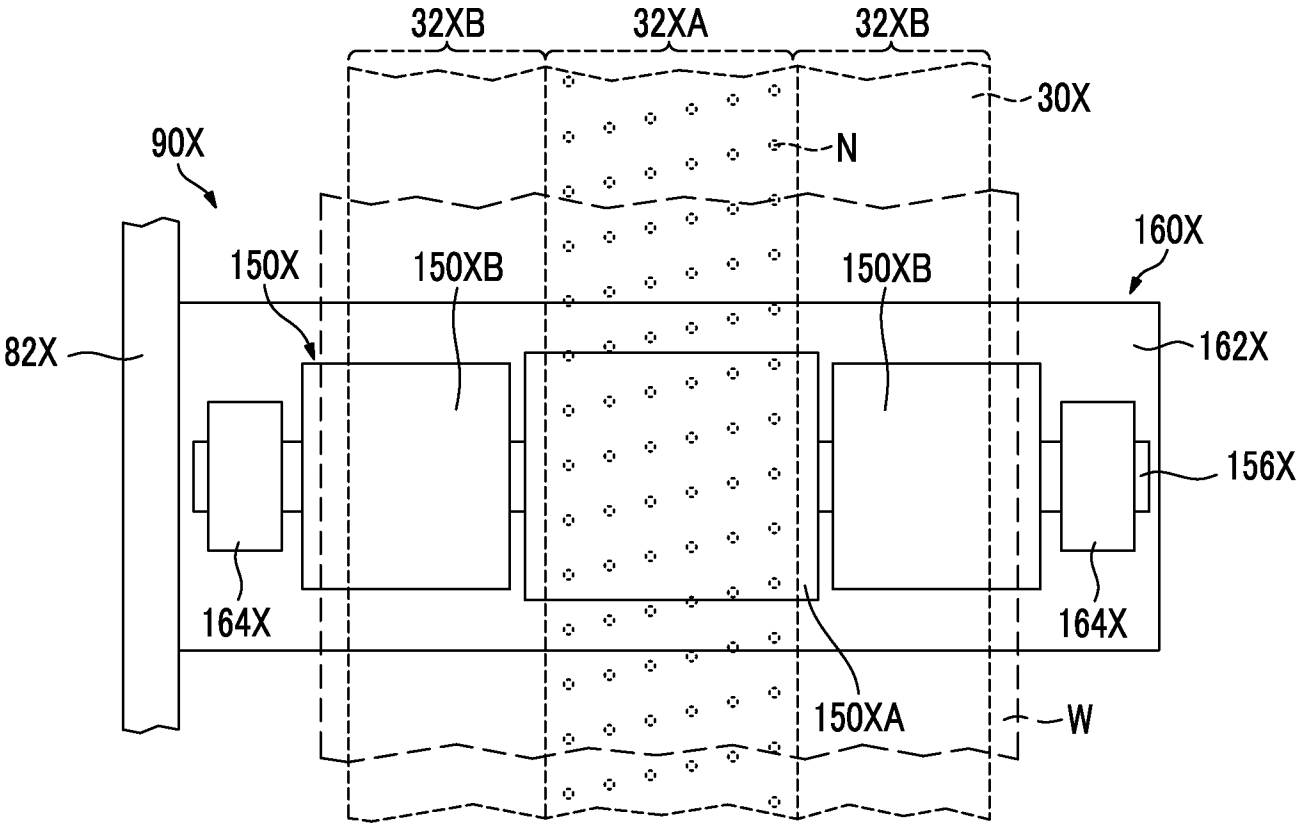
FIG. 9 is a plan view illustrating a configuration of a pressure unit.

FIG. 8 is a front view illustrating a configuration of the pressure unit. In addition, FIG. 9 is a plan view illustrating the configuration of the pressure unit.

The pressure unit 90X includes a pressure roller 150X, and winds the web W around the pressure roller 150X to bring the web W into pressing contact with the nozzle surface 32X.

The pressure roller 150X is configured to coaxially dispose the elastic body roller 150XA, which is elastically deformable, and the pair of rigid body rollers 150XB, each of which is configured by a rigid body.

The elastic body roller 150XA includes a core portion 152XA and an elastic body portion 154XA disposed around the core portion 152XA.

The core portion 152XA is formed in a cylindrical shape having a constant thickness. The core portion 152XA is configured by a rigid body, for example, and is formed of metals.

The elastic body portion 154XA is formed in a cylindrical shape having a constant thickness, and is integrally fixed and disposed on the outer periphery of the core portion 152XA.

The elastic body portion 154XA is formed using an elastically deformable material, for example, is formed of sponge or silicon rubber.

The outer diameter DA of the elastic body roller 150XA is formed to be larger than the outer diameter DB of the rigid body roller 150XB (i.e., DA>DB). In addition, the elastic body roller 150XA is formed to be slightly wider than the nozzle region 32XA formed on the nozzle surface 32X in width.

The rigid body roller 150XB includes the core portion 152XB and the rigid body portion 154XB disposed around the core portion 152XB.

The core portion 152XB is formed in a cylindrical shape having a constant thickness. The core portion 152XB is configured by a rigid body, and is formed using the same material as used in the core portion 152XA of the elastic body roller 150XA.

The rigid body portion 154XB is formed in a cylindrical shape having a constant thickness, and is integrally fixed and disposed on the outer periphery of the core portion 152XB. The rigid body portion 154XB is formed of a material having rigidity, for example, is formed of a resin and the like.

As described above, the outer diameter DB of the rigid body roller 150XB is formed to be smaller than the outer diameter DA of the elastic body roller 150XA (i.e., DB<DA). In addition, the rigid body roller 150XB is formed to be slightly wider than the non-nozzle region 32XB formed on the nozzle surface 32X in width.

The elastic body roller 150XA and the pair of rigid body rollers 150XB are rotatably supported by a spindle 156X functioning as the support member.

The elastic roller 150XA is disposed at the center of the spindle 156, and is rotatably supported by the spindle 156X through a bearing 158XA.

The pair of rigid body rollers 150XB are disposed at both sides of the elastic body roller 150XA at a constant gap. Each rigid body roller 150XB is rotatably supported by the spindle 156X through the bearing 158XB.

Accordingly, the elastic body roller 150XA and the pair of rigid body rollers 150XB are rotatably supported by the spindle 156X and are coaxially disposed. The elastic body roller 150XA and the pair of rigid body rollers 150XB are supported by the spindle 156X through the bearings 158XA and 158XB, respectively, so that these are supported so as to be rotatable independently from each other. That is, each is supported so as to be rotatable independently from each other without being affected by other rollers.

In this embodiment, as described above, the outer diameter DA of the elastic body roller 150XA is formed to be larger than the outer diameter DB of the rigid body roller 150XB. Accordingly, the elastic body roller 150XA further protrudes than the rigid body roller 150XB by the difference in outer diameter (i.e., by [DA−DB]/2).

The pressure roller 150X is supported by a pressure roller support portion 160X, and is disposed at a predetermined position.

The pressure roller support portion 160X includes a mounting table 162X provided in the head cleaning apparatus main body frame 82X, and a pair of shaft support portions 164X provided on the mounting table 162X thereof.

The mounting table 162X is formed in a plate shape, and has one end fixed to the head cleaning apparatus main body frame 82X to be horizontally (parallel to the feeding shaft 84X and the winding shaft 86X) disposed.

The pair of shaft support portions 164X is disposed at a constant interval on the mounting table 162X, and integrally fixed to the mounting table 162X.

The shaft support portions 164X include the shaft support portion main bodies 166X formed in a block shape. The shaft support portion main bodies 166X include long holes 168X through which the spindle 156X of the pressure roller 150X is inserted. The long holes 168X are formed along the vertical direction.

In the long holes 168X, the pressure plates 170X are disposed. The pressure plates 170X are provided to be vertically movable along the long holes 168X in the long holes.

At the lower portion of the pressure plates 170X, springs 172X functioning as the biasing unit are disposed. The springs 172X bias the pressure plates 170X upwardly (the pressure direction of the nozzle surface).

The pressure roller 150X inserts both end portions of the spindle 156X through the long holes 168X of the shaft support portions 164, respectively, and is supported by the pressure roller support portion 160X. The spindle 156X inserted through the long holes 168X is biased by the spring 172X through the pressure plate 170X, and is pushed upward. When the web W is brought into pressing contact with the nozzle surface 32X, the web W is brought into pressing contact with the nozzle surface 32X using the biasing force of the spring 172X.

This biasing force of the spring 172X is set to a sufficient force to elastically deform the elastic body portion 154XA of the elastic body roller 150XA.

The pressure unit 90X is configured as described above.

Operation of Pressure Unit

As described above, the cleaning of the nozzle surface 32X is performed by bringing the web W into pressing contact with the nozzle surface 32X of the head 30X through the pressure roller 150X.

The pressure roller 150X is brought into pressing contact with the nozzle surface 32X by moving the head cleaning apparatus 80X to the wiping position. However, at this time, the pressure roller 150X is brought into pressing contact with the nozzle surface 32X using the biasing force of the spring 172X included in the shaft support portion 164X. Accordingly, even if a position of the pressure roller 150X and a position of the nozzle surface 32X are not exactly aligned, it is possible to appropriately bring the pressure roller 150X into pressing contact with the nozzle surface 32X.

In addition, the shaft support portion 164X is configured to support both ends of the spindle 156X of the pressure roller 150X, so that, even in a case where the pressure roller 150X is inclined or the like, it is possible to easily fit to the nozzle surface 32X and bring the pressure roller 150X into pressing contact with the nozzle surface 32X.

The pressure roller 150X includes the elastic body roller 150XA and the rigid body rollers 150XB. The outer diameter DA of the elastic body roller 150XA is formed to be larger than the outer diameter DB of the rigid body roller 150XB. Therefore, if the pressure roller 150X is biased using the spring 172X and brought into pressing contact with the nozzle surface 32X, the elastic body roller 150XA is first brought into pressing contact with the nozzle surface 32X.

The outer periphery portion of the elastic body roller 150XA is formed using an elastic body portion 154XA. Accordingly, when brought into pressing contact with the nozzle surface 32X, the elastic body roller 150XA is defeated and crushed by the biasing force of the springs 172X.

Figure 10:
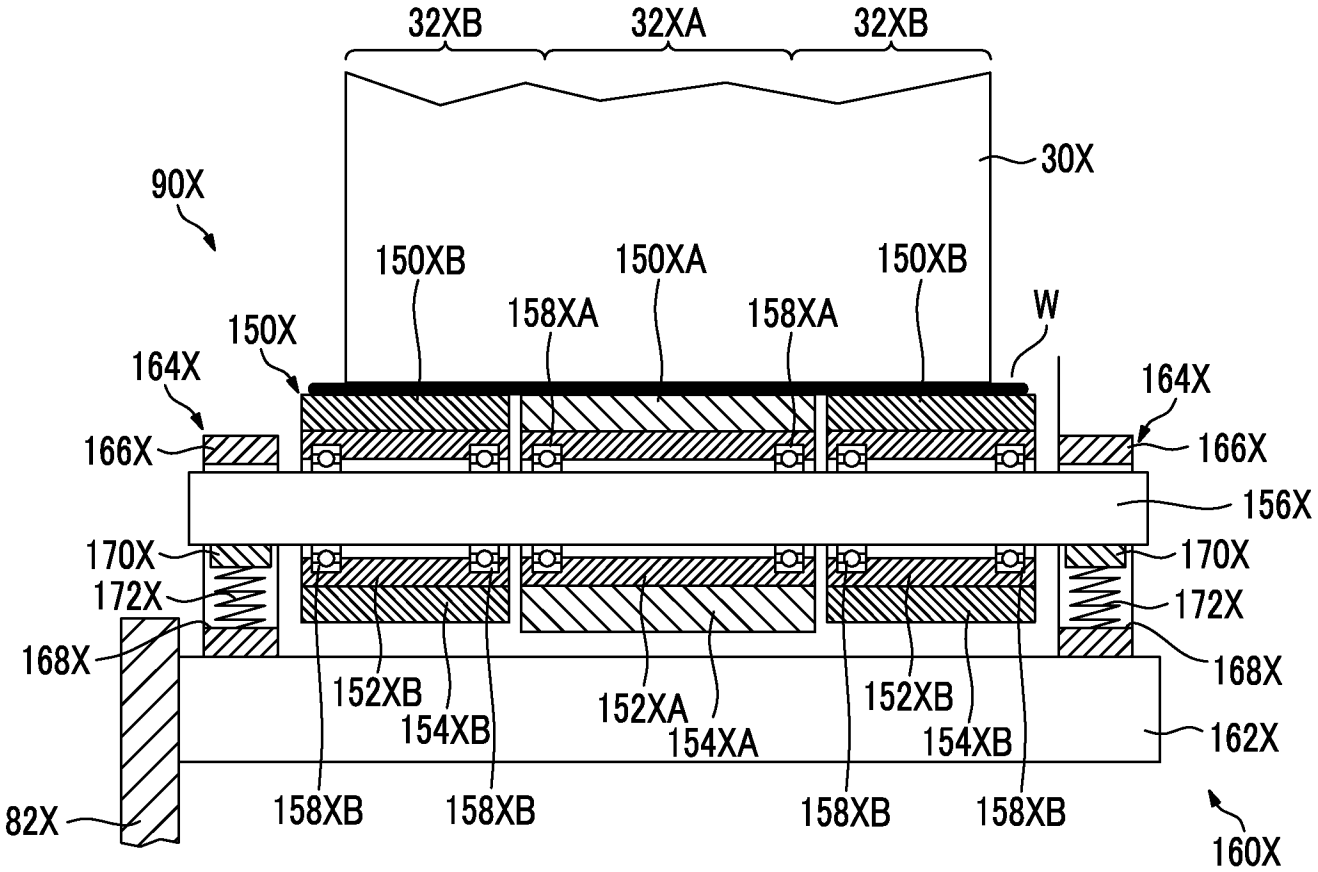
FIG. 10 is a view describing an operation of the pressure unit.

As the result, as illustrated in FIG. 10, the pair of rigid boy rollers 150XB are brought into pressing contact with the nozzle surface 32X. The outer periphery portion of each rigid body roller 150XB is configured by a rigid body, so that the pair of rigid body rollers 150XB may be brought into pressing contact with the nozzle surface 32X without being deformed.

In this way, when the pressure roller 150X is brought into pressing contact with the nozzle surface 32X, the elastic body roller 150XA is brought into pressing contact with the nozzle surface 32X in a crushed state. The elastic body roller 150XA is crushed, and accordingly the elastic restoring force acts thereon. The elastic body roller 150XA presses the nozzle surface 32X with the restoring force. As this force is constant, a constant pressing force acts on the nozzle surface 32X at a portion where the elastic body roller 150XA is provided.

In other words, a force that the elastic body roller 150XA applies to the nozzle surface 32X is the elastic restoring force obtained when the elastic body roller 150XA is crushed. The elastic restoring force is uniquely determined depending on the amount of the crush of the elastic body roller 150XA, and therefore it is possible to cause a constant pressure to act on the nozzle surface 32X.

The portion of the nozzle surface 32X which is pressed by the elastic body roller 150XA through the web W is a nozzle region 32XA, and liquid-repellent processing is performed in the nozzle region 32XA. By pressing with an appropriate pressing force using the elastic body roller 150XA, it is possible to wipe the surface of the nozzle region 32XA in which the liquid-repellent processing is performed without a damage. Accordingly, it is possible to prolong the durability of the head 30X.

As described above, the force that elastic body roller 150XA applies to the nozzle surface 32X is the elastic restoring force by the elastic body roller 150XA, and the elastic restoring force is uniquely determined depending on the amount of crush of the elastic body roller 150XA. The amount of the crushed elastic body roller 150XA is determined depending on the protrusion amount (in the example, a difference in outer diameters ([DA−DB]/2)) of the elastic body roller 150XA with respect to the rigid body roller 150XB. Accordingly, by adjusting the protrusion amount of the elastic body roller 150XA with respect to the rigid body roller 150XB, it is possible to adjust a pressure amount. Accordingly, simply adjusting the protrusion amount of the elastic body roller 150XA against the rigid body roller 150XB can make it possible to adjust the pressure amount. In this manner, it is possible to simply adjust the pressing force to an appropriate pressing force and to bring the web W into pressing contact with the nozzle surface 32X.

In addition, the elastic body roller 150XA and the rigid body roller 150XB are different in outer diameter, and supported so as to be rotatable independently from each other. Accordingly, without causing slip, it is possible to stably bring the web W into pressing contact with the nozzle surface 32X.

As described above, according to the head cleaning apparatus 80X of the embodiment, it is possible to bring the web W into pressing contact with the nozzle surface 32X with an appropriate pressing force to wipe the nozzle surface 32X. In addition, it is possible to easily adjust the pressing force and to set the pressing force to a weak force. Accordingly, it is possible to prevent the nozzle surface 32X from being damaged by wiping. Therefore, it is possible to prolong the durability of the head 30X.

Another Embodiment of Pressure Unit

In the pressure unit 90X of the above described embodiment, the elastic body pressing member is configured by the elastic body roller 150XA and the rigid body pressing member is configured by the rigid body rollers 150XB, and is configured to be rotatably supported by the spindle 156X. However, the elastic body pressing member and the rigid body pressing member may be formed in other shape than the roller shape, and may not be rotatably supported. Any other configuration may be applicable as long as the elastic body pressing member is disposed with a step provided with respect to the rigid body pressing member (disposed to be protruded) and thereby being brought into contact with the nozzle surface 32X in a crushed state.

Figure 11:
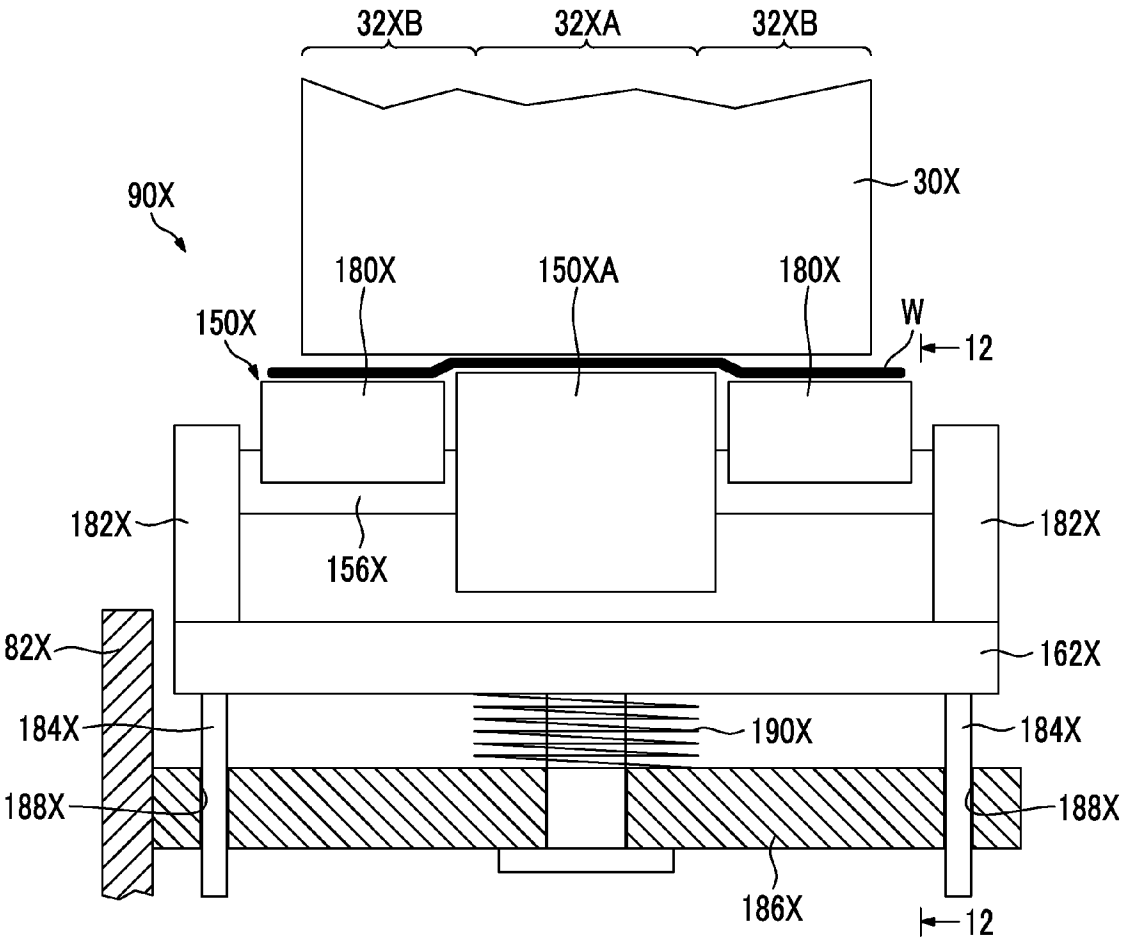
FIG. 11 is a front view illustrating another embodiment of the pressure unit.
Figure 12:
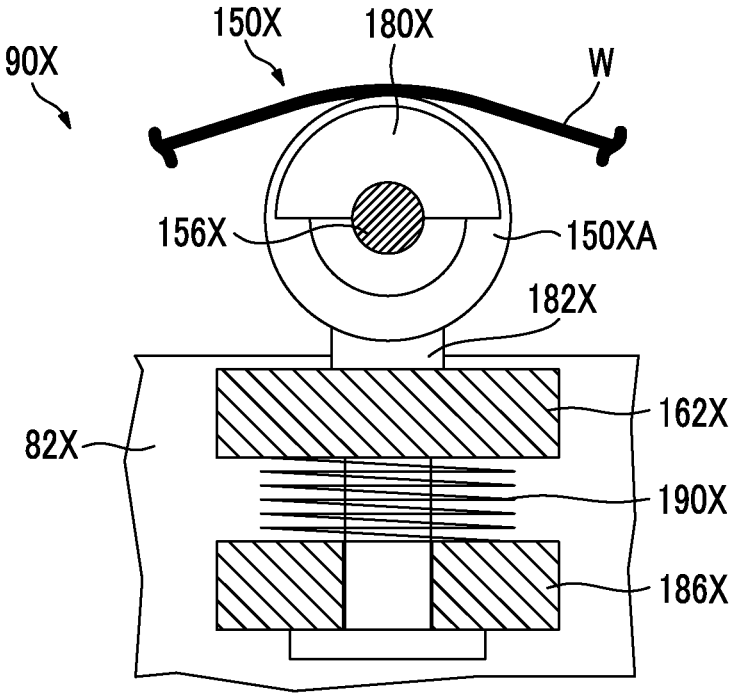
FIG. 12 is a cross-sectional view taken along line 12-12 of FIG. 11.

For example, in the example illustrated in FIGS. 11 and 12 (FIG. 12 is a cross-sectional diagram taken along a line 12-12 of FIG. 11), the rigid body pressing member is fixed and attached to the spindle 156X. Specifically, the rigid body frame 180X as the rigid body pressing member is fixed and attached to the spindle 156X. The rigid body frame 180X is formed to have a semicircular block shape in a cross sectional view (a shape in which the upper half of the rigid body roller 150XB is cut out), and the web W is wound on the circular-arc surface.

Although not illustrated, an elastic body frame as the elastic body pressing member may also be configured to be fixed and attached to the spindle 156X in the same manner.

However, if the rigid body pressing member and the elastic body pressing member are fixed and attached to the spindle 156X, they may slip with the web. Accordingly, the rigid body pressing member and the elastic body pressing member may be formed in a roller shape and rotatably supported.

In addition, when the rigid body pressing member and the elastic body pressing member are formed in a roller shape, a difference in peripheral speed is generated due to a difference between the outer diameters thereof. Accordingly, like the above-mentioned embodiments, the rigid body roller and the elastic body roller may be supported so as to be rotatable independently from each other.

Although the elastic body roller 150XA and the rigid body roller 150XB are configured to be supported by the same spindle 156X in the above-mentioned embodiments, they may be configured to be supported by different spindles. In this case, the elastic body roller 150XA and the rigid body roller 150XB may be disposed on the same straight line. With such configuration, it is possible to reduce the size of the head cleaning apparatus.

In addition, in the example illustrated in FIG. 11, the both ends of the spindle 156X is fixed to a strut 182X erectly provided on the mounting table 162X, and the mounting table 162X is biased using the spring 190X to bring the pressure roller 150X into pressing contact with the nozzle 32X. Accordingly, it is also possible to bias every mounting table to bring the pressure roller 150X into pressing contact with the nozzle surface 32X.

In this case, the mounting table 162X is slidably supported in a vertical direction using a pair of guide rods 184X. The pair of guide rods 184X are perpendicularly attached to the lower surface portion of the mounting table 162X, and inserted through the guide hole 188X provided on a bracket 186X to be slidably supported in the vertical direction.

In addition, a spring 190X is disposed between the mounting table 162X and the bracket 186X, and the mounting table 162X is biased upwardly (the pressure direction of the nozzle surface).

Moreover, in the above-mentioned embodiment, a head is configured to move to wipe the nozzle surface, but the nozzle surface may be wiped by causing a head cleaning apparatus to move.

Additionally, in the above-mentioned embodiment, the web W is configured to be provided with the cleaning solution before wiping and to be wiped in a moisturized state. However, in another configuration, the nozzle surface may be moisturized and may be wiped using the web W which is in a dried state. In order to have the nozzle surface be moisturized, for example, methods may be adopted, in which the nozzle surface is provided with the cleaning solution and is moisturized before being wiped by the web, or in which the ink is caused to overflow from a nozzle and thereby the nozzle surface is moisturized.

Furthermore, in the above-mentioned embodiment, the case of cleaning the nozzle surface of a line head is described as an example. However, the present invention is applicable even in a case of cleaning the nozzle surface of a shuttle head.

In addition, in the above-mentioned embodiment, a case of applying the present invention to the head cleaning recording apparatus is described as an example. However, the application of the present invention is not restricted thereto. As long as the head (the droplet ejection head) ejects a droplet from a nozzle formed on the nozzle surface, it may be used in a head cleaning at any purpose.

In addition, in the above-described embodiment, a case of cleaning the head is described, of which the nozzle region is formed at the center portion of the nozzle surface in the width direction, and the non-nozzle region is formed with the nozzle region interposed. However, the configuration of the head is not restricted thereto. For example, it is possible to apply the above-described configuration to the case of cleaning the head in which the nozzle is entirely formed on the nozzle surface in the same manner.

In addition, it is possible to apply the configuration to the case of cleaning the head in which the nozzle region is retreated and formed in a recess shape with respect to the non-nozzle region in the same manner. In this case, having the width of the elastic body roller wider than the width of the nozzle region may appropriately wipe even a step portion provided between the nozzle region and the non-nozzle region.

What is claimed is:

1. A head cleaning apparatus configured to move relatively along a nozzle surface of a droplet ejection head to clean the nozzle surface, the head cleaning apparatus comprising:

a web configured to wipe the nozzle surface;

a web driving unit configured to cause the web to travel in a direction which is orthogonal to a width direction of the web;

a pair of rigid body pressing members configured to press both end portions of the web in the width direction of the web respectively to the nozzle surface;

an elastic body pressing member provided between the pair of rigid body pressing members and provided to further protrude to a nozzle surface side than the pair of rigid body pressing members, the elastic body pressing member being configured to press a center portion of the web in the width direction of the web to the nozzle surface; and a support member configured to support the pair of rigid body pressing members and the elastic body pressing member.

2. The head cleaning apparatus according to claim 1, wherein each elastic body pressing member is configured by an elastic body roller, and is supported by the support member so as to be rotatable independently.

3. The head cleaning apparatus according to claim 2, wherein the rigid body pressing member is configured by a rigid body roller and is supported by the support member so as to be rotatable independently.

4. The head cleaning apparatus according to claim 3, wherein an outer diameter of the elastic body roller is greater than an outer diameter of the rigid body roller, and the elastic body roller and the rigid body roller are coaxially provided.

5. The head cleaning apparatus according to claim 4, wherein the nozzle surface of the droplet ejection head includes:

the nozzle region at a center portion of the nozzle surface in the width direction of the nozzle surface; and non-nozzle regions at both end portions of the nozzle surface in the width direction of the nozzle surface; and wherein the pair of rigid body pressing members are configured to press respective end portions of the web in the width direction of the web to the non-nozzle regions.

6. The head cleaning apparatus according to claim 5, wherein the elastic body pressing member is wider than the nozzle region in width.

7. The head cleaning apparatus according to claim 2, wherein the nozzle surface of the droplet ejection head includes:

the nozzle region at a center portion of the nozzle surface in the width direction of the nozzle surface; and non-nozzle regions at both end portions of the nozzle surface in the width direction of the nozzle surface; and wherein the pair of rigid body pressing members are configured to press respective end portions of the web in the width direction of the web to the non-nozzle regions.

8. The head cleaning apparatus according to claim 7, wherein the elastic body pressing member is wider than the nozzle region in width.

9. The head cleaning apparatus according to claim 2, further comprising a biasing unit configured to bias the support member toward the nozzle surface.

10. The head cleaning apparatus according to claim 3, wherein the nozzle surface of the droplet ejection head includes:

the nozzle region at a center portion of the nozzle surface in the width direction of the nozzle surface; and non-nozzle regions at both end portions of the nozzle surface in the width direction of the nozzle surface; and wherein the pair of rigid body pressing members are configured to press respective end portions of the web in the width direction of the web to the non-nozzle regions.

11. The head cleaning apparatus according to claim 10, wherein the elastic body pressing member is wider than the nozzle region in width.

12. The head cleaning apparatus according to claim 3, further comprising a biasing unit configured to bias the support member toward the nozzle surface.

13. The head cleaning apparatus according to claim 4, further comprising a biasing unit configured to bias the support member toward the nozzle surface.

14. The head cleaning apparatus according to claim 1, wherein the nozzle surface of the droplet ejection head includes:

a nozzle region at a center portion of the nozzle surface in a width direction of the nozzle surface; and non-nozzle regions at both end portions of the nozzle surface in the width direction of the nozzle surface; and wherein the pair of rigid body pressing members are configured to press respective end portions of the web in the width direction of the web to the non-nozzle regions.

15. The head cleaning apparatus according to claim 14, wherein the elastic body pressing member is wider than the nozzle region in width.

16. The head cleaning apparatus according to claim 1, further comprising a biasing unit configured to bias the support member toward the nozzle surface.

17. The head cleaning apparatus according to claim 16, wherein the biasing unit is configured in a pair and biases both end portions of the support member in a width direction.

18. The head cleaning apparatus according to claim 1, further comprising a cleaning solution providing unit configured to provide the web with a cleaning solution, wherein the web moisturized with the cleaning solution is pressed to the nozzle surface by the pair of rigid body pressing members and the elastic body pressing member.

19. A droplet ejection apparatus comprising:

a recording medium transportation unit configured to transport a recording medium;

a droplet ejection head configured to eject a droplet to the recording medium transported by the recording medium transportation unit; and the head cleaning apparatus according to claim 1 configured to move relatively along a nozzle surface of the droplet ejection head to clean the nozzle surface.

* * * * *